US011791549B2

(12) United States Patent
McCraven

(10) Patent No.: US 11,791,549 B2
(45) Date of Patent: Oct. 17, 2023

(54) ANTENNA CAP AND METHOD OF INSTALLING THE SAME

(71) Applicant: Mueller International, LLC, Atlanta, GA (US)

(72) Inventor: Jeremy Alan McCraven, Kannapolis, NC (US)

(73) Assignee: Mueller International LLC, Atlanta, GA (US)

( * ) Notice: Subject to any disclaimer, the term of this patent is extended or adjusted under 35 U.S.C. 154(b) by 0 days.

(21) Appl. No.: 18/071,338

(22) Filed: Nov. 29, 2022

(65) Prior Publication Data

US 2023/0106009 A1 Apr. 6, 2023

Related U.S. Application Data

(62) Division of application No. 16/119,144, filed on Aug. 31, 2018, now Pat. No. 11,545,742.

(51) Int. Cl.
*H01Q 1/42* (2006.01)
*H01Q 1/22* (2006.01)
*H01Q 1/12* (2006.01)

(52) U.S. Cl.
CPC ..... *H01Q 1/42* (2013.01); *H01Q 1/1221* (2013.01); *H01Q 1/2233* (2013.01)

(58) Field of Classification Search
CPC .... H01Q 1/2233; H01Q 1/085; H01Q 1/1207; H01Q 1/42
See application file for complete search history.

(56) References Cited

U.S. PATENT DOCUMENTS 4,210,914 A * 7/1980 Blackman ..... H01Q 1/088 343/715
5,793,258 A * 8/1998 Lange ..... H01Q 1/247 343/753
5,973,646 A * 10/1999 Engblom ..... H01Q 1/242 343/702
6,326,925 B1 * 12/2001 Perkio ..... H01Q 1/1207 343/702
6,441,788 B1 8/2002 Ishizuka et al.
6,748,802 B1 6/2004 Hendey
11,349,189 B2 * 5/2022 Kawano ..... H01Q 21/06
(Continued)

OTHER PUBLICATIONS

McCraven, Jeremy Alan; Final Office Action for U.S. Appl. No. 16/119,144, filed Aug. 31, 2018, dated Jan. 31, 2022, 19 pgs.
(Continued)

*Primary Examiner* — Ricardo I Magallanes
(74) *Attorney, Agent, or Firm* — Taylor English Duma LLP

(57) ABSTRACT

An antenna cap includes a housing defining an elongate continuous sidewall, the continuous sidewall defining a first end and a second end, an end wall extending from the first end, the end wall and continuous sidewall defining an interior cavity for receiving an antenna, an opening defined at the second end and configured for access to the interior cavity; and a fastener proximate the second end and configured for attaching the housing to the antenna node, the fastener formed with the continuous sidewall, wherein a length of the continuous sidewall between the first end and the fastener is greater than a length of the fastener, and wherein the continuous sidewall defines a consistent outer sidewall diameter from the first end to the fastener.

15 Claims, 4 Drawing Sheets

(56) References Cited

U.S. PATENT DOCUMENTS

| | | | | |
|---|---|---|---|---|
| 11,545,742 | B2 | 1/2023 | McCraven | |
| 2004/0129499 | A1 | 7/2004 | Okpokowuruk | |
| 2004/0194994 | A1* | 10/2004 | Rasmussen | H01Q 1/50 174/76 |
| 2012/0075161 | A1 | 3/2012 | Elwell et al. | |
| 2012/0194405 | A1* | 8/2012 | Brink | H01Q 1/50 343/872 |
| 2016/0028149 | A1* | 1/2016 | Armas | H01Q 21/064 29/601 |
| 2020/0076067 | A1 | 3/2020 | McCraven | |

OTHER PUBLICATIONS

McCraven, Jeremy Alan; Final Office Action for U.S. Appl. No. 16/119, 144, filed Aug. 31, 2018, dated Apr. 12, 2021, 16 pgs.
McCraven, Jeremy Alan; Non-Final Office Action for U.S. Appl. No. 16/119,144, filed Aug. 31, 2018, dated Oct. 19, 2020, 12 pgs.
McCraven, Jeremy Alan; Non-Final Office Action for U.S. Appl. No. 16/119,144, filed Aug. 31, 2018, dated Jun. 6, 2022, 13 pgs.
McCraven, Jeremy Alan; Non-Final Office Action for U.S. Appl. No. 16/119,144, filed Aug. 31, 2018, dated Jul. 15, 2021, 16 pgs.
McCraven, Jeremy Alan; Notice of Allowance for U.S. Appl. No. 16/119,144, filed Aug. 31, 2018, dated Sep. 9, 2022, 9 pgs.
McCraven, Jeremy Alan; Requirement for Restriction/Election for U.S. Appl. No. 16/119,144, filed Aug. 31, 2018, dated Apr. 29, 2022, 6 pgs.

* cited by examiner

ANTENNA CAP AND METHOD OF INSTALLING THE SAME

CROSS-REFERENCE TO RELATED APPLICATIONS

The present application is a divisional of U.S. application Ser. No. 16/119,144, filed Aug. 31, 2018, which is hereby specifically incorporated by reference herein in its entirety.

TECHNICAL FIELD

This disclosure relates to antenna assemblies. More specifically, this disclosure relates to an antenna assembly comprising a protective cap.

BACKGROUND

An antenna node can comprise an antenna, which can transmit a signal by radiating radio waves carrying the signal. In some cases, a water meter, such as in a residential or commercial building, can be attached to an antenna node, and the antenna node can wirelessly transmit water consumption data to a meter reading device.

Antennas are commonly formed as a long, thin structure that can be fragile and prone to damage when exposed. Damage can occur during transportation of the antenna to an installation site, during installation, or post-installation. Causes of damage can include, but are not limited to, carrying the antenna node by the antenna, propping the antenna node on/via the antenna, and bumping the antenna into other objects.

SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts off the disclosure as an introduction to the following complete and extensive detailed description.

Disclosed is an antenna cap for an antenna node comprising a housing, the housing defining a continuous sidewall, the continuous sidewall defining a first end and a second end, an end wall at the first end, the end wall and continuous sidewall defining an interior cavity for receiving an antenna, an opening at the second end for access to the interior cavity, the continuous sidewall comprising a fastener proximate the second end for attaching the housing to the antenna node.

Also disclosed is an antenna assembly comprising an antenna node comprising a node housing and an antenna, the antenna extending outward from the node housing, the node housing comprising a fastener; and an antenna cap comprising a cap housing, the cap housing defining an interior cavity and a mating fastener, the antenna received in the interior cavity, the fastener engaging the mating fastener to attach the antenna cap to the antenna node.

A method for assembly an antenna assembly is also disclosed, the method comprising providing an antenna node, the antenna node comprising an antenna; inserting the antenna into a cavity of an antenna cap; and attaching the antenna cap to the antenna node.

Additionally, disclosed is an antenna cap for an antenna node comprising a housing, the housing defining an elongate continuous sidewall, the continuous sidewall defining a first end and a second end, an end wall extending from the first end, the end wall and continuous sidewall defining an interior cavity for receiving an antenna, an opening defined at the second end and configured for access to the interior cavity, wherein the end wall defines a flat center region and a curved peripheral region surrounding the flat center region, the curved peripheral region flush with the first end of the continuous sidewall to define a smooth transition between the end wall and the continuous sidewall, the flat center region perpendicular to the continuous sidewall; and a fastener proximate the second end and configured for attaching the housing to the antenna node, the fastener formed with the continuous sidewall, wherein a length of the continuous sidewall between the first end and the fastener is greater than a length of the fastener, and wherein the continuous sidewall defines a consistent outer sidewall diameter from the first end to the fastener; wherein the antenna cap defines an outer surface, and wherein a maximum diameter of the outer surface at the fastener is less than the consistent outer sidewall diameter.

Also disclosed is a method for installing an antenna assembly on equipment comprising providing the antenna assembly comprising an antenna cap, an antenna node, and an antenna, the antenna cap defining an interior cap cavity, the antenna node comprising a node housing and a collar monolithically formed with and extending from the node housing; receiving a first portion of the antenna through an opening of the collar and into a housing cavity of the node housing; receiving a second portion of the antenna into the interior cap cavity; attaching the antenna cap to the collar of the antenna node; abutting a mounting bracket of the antenna assembly with the equipment; and fastening the mounting bracket of the antenna assembly to the equipment with a mounting fastener.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1:
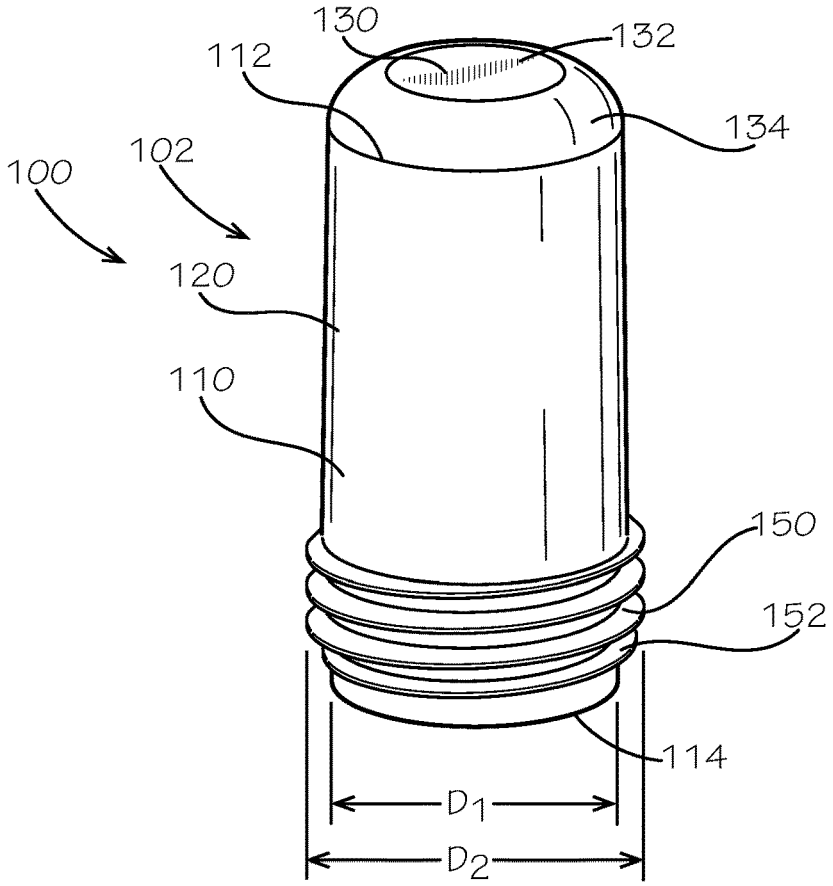
FIG. 1 is a top perspective view of an antenna cap, in accordance with one aspect of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed in the present application is an antenna cap for an antenna node and associated methods, systems, devices, and various apparatus. Example aspects of the antenna cap can comprise a cap housing and a fastener for attaching the cap housing to the antenna node. It would be understood by one of skill in the art that the disclosed antenna cap is described in but a few exemplary aspects among many. No particular terminology or description should be considered limiting on the disclosure or the scope of any claims issuing therefrom.

Figure 2:
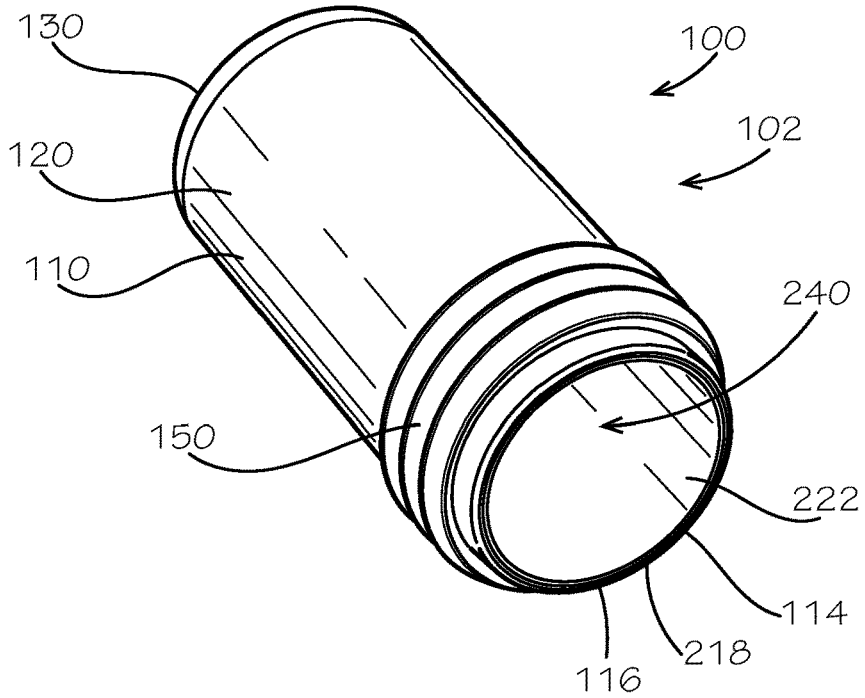
FIG. 2 is a bottom perspective view of the antenna cap of FIG. 1.

FIGS. 1 and 2 illustrate a first aspect of an antenna cap 100 according to the present disclosure. As shown, the antenna cap 100 can comprise a cap housing 102. The cap housing 102 can define a cylindrical sidewall 110 defining a first end 112 an opposite second end 114. The cylindrical sidewall 110 can further define an outer surface 120 and an inner surface 222 (shown in FIG. 2). The outer surface 120 of the sidewall 110 can define a diameter D1. As shown, the cylindrical sidewall 110 can define a circular cross-sectional shape. However, in other aspects, the sidewall 110 can define another cross-sectional shape, such as, for example, triangle, square or rectangle, pentagon, oval, or any other suitable shape.

The cap housing 102 can further define an end wall 130. The end wall 130 can be formed at the first end 112 of the cylindrical sidewall, such that the first end 112 of the sidewall 110 is closed. Example aspects of the end wall 130 can define an outer surface 132 and an inner surface (not shown). Furthermore, the outer surface 132 of the end wall 130, or portions thereof, can be curved in some aspects. For example, as shown, a peripheral region 134 of the end wall 130 can be curved to define a smooth transition between the end wall 130 and the cylindrical sidewall 110.

Furthermore, according to example aspects, the inner surface 222 of the cylindrical sidewall 110 and the inner surface (not shown) of the end wall 130 can define an interior cap cavity 240 (shown in FIG. 2). Example aspects of the interior cap cavity 240 can be sized and shaped to receive an antenna 480 (shown in FIG. 4) therein. Moreover, the second end 114 of the cylindrical sidewall 110 can define a peripheral edge 116. The peripheral edge 116 of the sidewall 110 can define an opening 218 (shown in FIG. 2), and the opening 218 can allow access to the interior cap cavity 240.

Example aspects of the antenna cap 100 can comprise a fastener 150 formed on the sidewall 110 at or near the second end 114 of the sidewall 110. In some aspects, the fastener 150 can formed as threading 152. As shown in the depicted aspect, the threading 152 can extend outward from the outer surface 120 of the cylindrical sidewall 110, such that the threading 152 can define a greater diameter D2 than a diameter D1 of the sidewall 110. However, in other aspects, such as the aspect shown in FIG. 3, the threading 152 can extend into the outer surface 120 of the sidewall 110, such that the diameter D2 of the threading 152 can be less than or about equal to the diameter D1 of the sidewall 110. In other aspects, wherein the sidewall 110 defines a cross-sectional shape other than a circle, the threading 152 can define a width that is greater than, equal to, or less than a width of the sidewall 110. Furthermore, in other aspects, the fastener 150 can be oriented on the inner surface 222 of the cylindrical sidewall 110.

Figure 3:
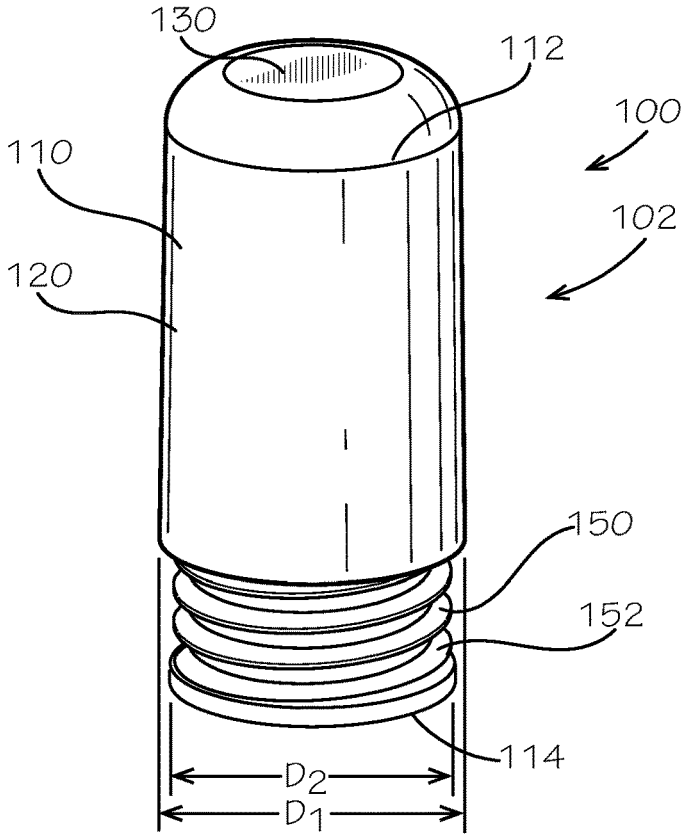
FIG. 3 is a top perspective view of the antenna cap, in accordance with another aspect of the present disclosure.

In example aspects of the antenna cap 100, such as the aspect depicted in FIGS. 1-2 and the aspect depicted in FIG. 3, the sidewall 110 can define a uniform sidewall diameter D1, except for the portion of the sidewall comprising the threading 152. In other aspects, the diameter D1 of the sidewall 110 can taper outward from the first end 112 to the second end 114, such that a diameter of the sidewall 110 at the first end 112 is less than a diameter of the sidewall 110 at the second end 114. In still other aspects, the diameter D1 of the sidewall 110 can taper inward from the first end 112 to the second end 112, such that a diameter of the sidewall 110 at the first end 112 is greater than a diameter of the sidewall 110 at the second end 112. In other aspects, wherein the sidewall 110 defines a cross-sectional shape other than a circle, the sidewall 110 can define a width that tapers inward, outward, or is uniform from the first end 112 of the sidewall 110 to the second end 114.

Figure 4:
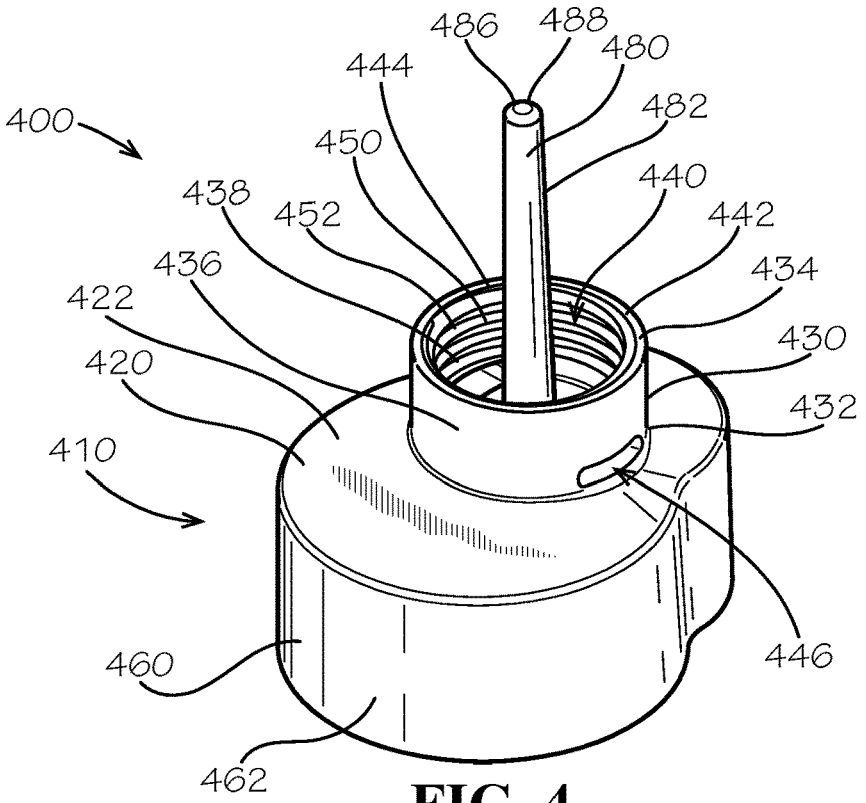
FIG. 4 is a top perspective view of an antenna node, in accordance with one aspect of the present disclosure.
Figure 5:
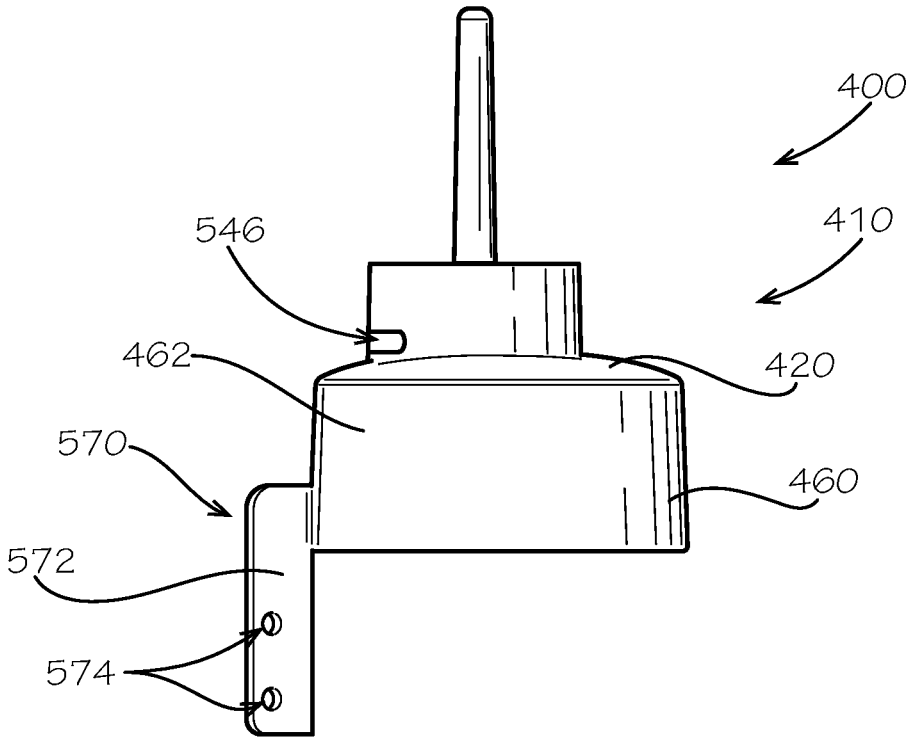
FIG. 5 is a perspective view of the antenna node of FIG. 4.
Figure 6:
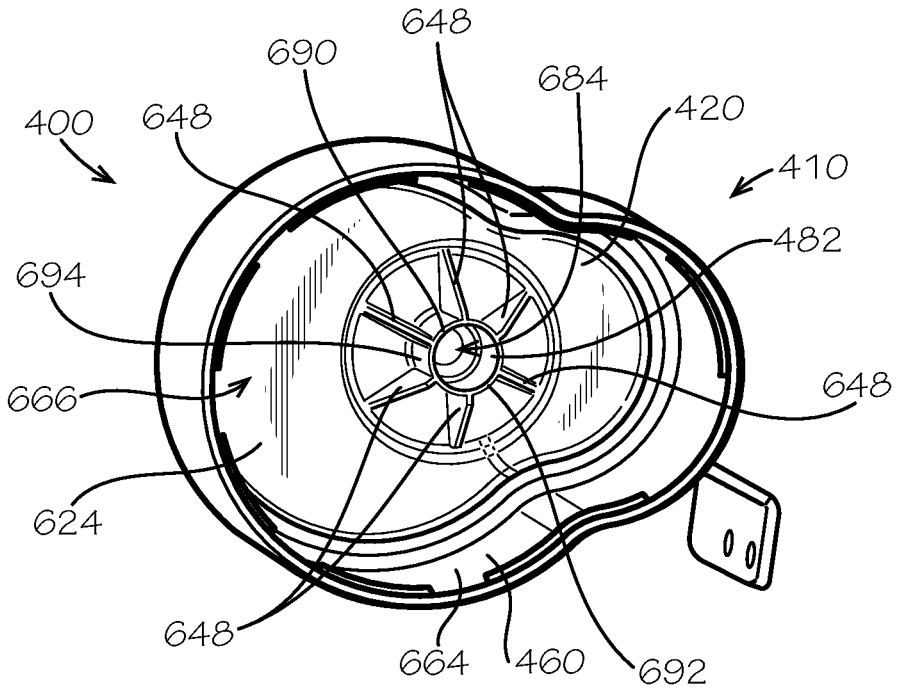
FIG. 6 is a bottom perspective view of the antenna node of FIG. 4.

FIGS. 4-6 illustrate an example aspect of an antenna node 400. Example aspects of the antenna node 400 can be similar to the antenna nodes shown and described in U.S. application Ser. No. 15/824,540, filed Nov. 28, 2017, and U.S. Pat. No. 9,912,038, filed Jul. 25, 2015, which are incorporated by reference herein in their entireties. As shown in FIG. 4, the antenna node 400 can comprise a node housing 410 and an antenna 480 extending therefrom. The node housing 410 can define a top cover 420 and a sidewall enclosure 460. The top cover 420 can define an outer surface 422 and an inner surface 624 (shown in FIG. 6), and the sidewall enclosure 460 can define an outer surface 462 and an inner surface 664 (shown in FIG. 6). The inner surfaces 624,664 of the top cover 420 and sidewall enclosure 460, respectively, can define a housing cavity 666 (shown in FIG. 6). Some aspects of the antenna node 400 can also further comprise a bottom cover (not shown) that can enclose or partially enclose the housing cavity 666.

According to example aspects, a collar 430 can extend upward from the top cover 420, as shown. Example aspects of the collar 430 can be substantially cylindrical in shape and can define a circular cross-sectional shape; however, other aspects of the collar 430 can define any other suitable cross-sectional shape, such as, for example, triangle, square or rectangle, pentagon, oval, or any other suitable shape. Optionally, the cross-sectional shape of the collar 430 can substantially match the cross-sectional shape of the sidewall 110 of the antenna cap 100. As shown, the cylindrical collar 430 can define a first end 432 and an opposite second end 434. The cylindrical collar 430 further can define an outer surface 436 and an inner surface 438. The inner surface 438 can define a collar bore 440 of the collar 430. As shown, the first end 432 of the cylindrical collar 430 can be attached to the top cover 420. In some aspects, the collar 430 can be monolithically formed with the top cover 420, while in other aspects, the cylindrical collar 430 can be attached to the top cover 420 by a fastener, such as, for example, adhesive, welding, or any other suitable fastener.

The second end 434 of the cylindrical collar 430 can define a peripheral edge 442, and the peripheral edge 442 can define an opening 444. The opening 444 can allow access to the collar bore 440 of the collar 430. As shown, example aspects of the cylindrical collar 430 can comprise a mating fastener 450. According to example aspects, the mating fastener 450 can be internal threading 452 formed on the inner surface 438 of the collar 430, which can be complementary to the external threading 152 of the antenna cap 100 (antenna cap 100 and threading 152 shown in FIG. 1), as will be described in further detail below. In some aspects, the internal threading 452 can extend about from the second end 434 of the collar 430 to the first end 432 of the collar 430. In other aspects, the threading 452 may not fully extend from the second end 434 to the first end 432. Furthermore, in some aspects, as shown, the threading 452 can extend into the inner surface 438 of the collar 430; however, in other aspects, the threading 452 can extend away from the inner surface 438 and into the collar bore 440. Furthermore, in still other aspects, the fastener 450 can be oriented on the outer surface 436 of the collar 430.

Example aspects of the collar 430 can also define a pair of elongated slots 446,546 extending from the outer surface 436 to the inner surface 438 of the collar 430 (slot 446 is shown in FIG. 4 and slot 546 is shown in FIG. 5). The slots 446,546 can extend in a substantially horizontal direction, relative to the orientation of FIG. 5. Other aspects of the slots 446,546 can extend in a different direction. The slots 446,546 can be positioned on opposing sides of the collar 430 and can be formed proximate the first end 432 of the collar 430 in some aspects. The slots 446,546 can allow fluid collected within collar bore 440 to drain out of the collar 430, preventing a buildup of fluid within the collar bore 440. Other aspects of the collar 430 can include more or fewer slots 446,546. Further, in other aspects, the slots 446,546 can be oriented elsewhere on the collar 430. In still other aspects, the slots 446,546 can be differently sized and/or shaped; for example, the slots 446,546 can be formed as circular holes.

In example aspects, the antenna 480 can extend outward from the top cover 420 and through the collar bore 440 of the collar 430. Example aspects of the antenna 480 can comprise a sheath 482 and a wire (wire not shown). The sheath 482 can define a first end 486 and a second end 690 (shown in FIG. 6). The first end 486 of the sheath 482 can be distal from the top cover 420. Furthermore, example aspects of the first end 486 can be a closed first end 488. Optionally, the sheath 482 can be oriented concentric to the collar bore 440. Furthermore, the sheath 482 can optionally be oriented substantially perpendicular to the top cover 420 of the node housing 410. As shown, example aspects of the sheath 482 can define a height greater than a height of the cylindrical collar 430, such that the antenna 480 extends beyond the second end 434 of the collar 430. In the present aspect, the sheath 482 of the antenna 480 can be integrally formed with the top cover 420; however in other aspects, the sheath 482 may not be integrally formed with the top cover 420 and can instead be attached to the top cover 420 by a fastener, such as an adhesive, threading, welding, or any other suitable attachment mechanism.

Referring to FIG. 5, example aspects of the node housing 410 can further comprise a mounting bracket 570 attached to the outer surface 462 of the sidewall enclosure 460, as shown. In other aspects, the mounting bracket 570 can be attached elsewhere to the node housing 410. The mounting bracket 570 can mount the antenna node 400 onto various equipment. For example, the mounting bracket 570 can mount the antenna node 400 to the water meter radio unit 710 (shown in FIG. 7), which can be directly wired to a water meter (not shown). Example aspects of the water meter radio unit 710 can be similar to the radio unit shown and described in U.S. Pat. No. 9,912,038, filed Jul. 25, 2015, which is incorporated by reference herein in its entirety. In example aspects, the mounting bracket 570 can define a substantially flat, elongated arm 572 extending outward and downward (i.e., away from the top cover 420) from the sidewall enclosure 460. The mounting bracket 570 can, in some aspects, further define one or more mounting holes 574 to aid in coupling the mounting bracket 570 to a piece of equipment (e.g., the water meter radio unit 710).

Referring to FIG. 6, the sheath 482 can define a sheath bore 684 therein. The second end 690 of the sheath 482 can be proximate to the top cover 420, as shown. Example aspects of the second end 690 of the sheath 482 can be an open second end 692 and can allow access to the sheath bore 684 at the second end 690, while the closed first end 488 (shown in FIG. 4) of the sheath 482 can prohibit access to the sheath bore 684 at the first end 486. In example aspects, a lower portion 496 of the sheath 482 can extend through the top cover 420 of the node housing 410 and into the housing cavity 666, such that the open second end 692 of the sheath 482 is oriented within the housing cavity 666. In some example aspects, as shown, one or more ribs 648 can extend from the inner surface 624 of the top cover 420 to the lower section 494 of the sheath 482 to reinforce the lower section 494 relative to the node housing 410. Example aspects of the ribs 648 can be triangular in shape and can be equally spaced around the lower section 494 of the sheath 482, as shown. In other aspects, the ribs 648 can be differently shaped and/or positioned. Still other aspects may not comprise the ribs 648.

In example aspects, various electronic equipment, such as, for example, a transmitter, can be disposed within the housing cavity 666, and can be configured to radiate, broadcast, or emit a signal over radio waves. In other aspects, other types of electronic equipment can be disposed within the housing cavity 666. In one aspect of the antenna node 400, the wire (not shown) of the antenna 480 (shown in FIG. 4) can extend along the sheath bore 684, through the open second end 692 of the sheath 482, and into the housing cavity 666. The wire can be connected to equipment (e.g., a transmitter) disposed in the housing cavity 666. In some aspects, the sheath 482 can comprise a dielectric insulation material, and the wire can comprise an electrically conductive material such as a metal. However, other aspects of the sheath 482 and the wire can be formed from other suitable materials known in the art.

Figure 7:
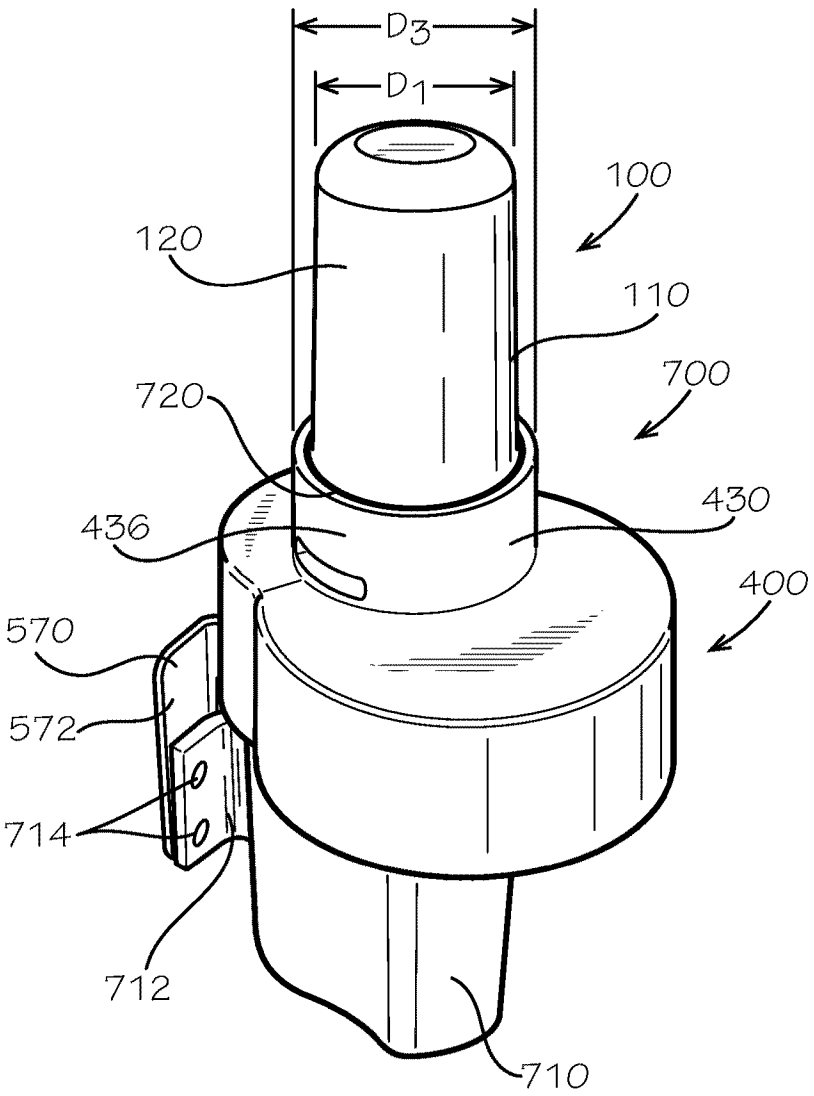
FIG. 7 is a top perspective view of an antenna assembly comprising the antenna node of FIG. 4 and the antenna cap of FIG. 1, in accordance with an aspect of the present disclosure.

FIG. 7 illustrates an antenna assembly 700 comprising the antenna node 400 and the antenna cap 100. The second end 114 (shown in FIG. 1) of the antenna cap 100 can be inserted through the opening 444 (shown in FIG. 4) of the collar 430 and received within the collar bore 440 (shown in FIG. 4). The internal threading 452 (shown in FIG. 4) of the collar 430 can engage the external threading 152 (shown in FIG. 1) of the antenna cap 100 to attach the antenna cap 100 to the antenna node 400. The antenna cap 100 can be twisted to tighten the engagement of the antenna cap 100 with the antenna node 400. In example aspects, the antenna cap 100 can be twisted until a stop surface (not shown) of the antenna cap 100 abuts a stop surface (not shown) of the antenna node 400.

According to example aspects, the cap cavity 240 (shown in FIG. 1) of the antenna cap 100 can be sized and shaped to receive the antenna 480 (shown in FIG. 4) therein when the antenna cap 100 is attached to the antenna node 400. With the antenna cap 100 covering the antenna 480, the antenna 480 can be protected from damage caused by external factors. For example, the antenna 480 can be protected from damage caused by contact with other objects during transportation, installation, or post-installation. Other examples of potential causes of damage can include the antenna node 400 being carried by the antenna 480 and the antenna node 400 be propped up by the antenna 480.

According to example aspects, the antenna cap 100 can be removably coupled to the antenna node 400, such that the antenna cap 100 can be removed, if desired. In one example instance, the antenna 480 can be a TTL antenna (i.e., a "through the lid" antenna) and the antenna node 400 can be installed with a lid of a pit vault (pit vault not shown). In such an aspect, the antenna cap 100 can be removed during installation, and the lid can engage the mating fastener 450 (shown in FIG. 4) of the antenna node 400. In other aspects, the antenna cap 100 can be selectively removed from the antenna node 400 for inspection or repair of the antenna 480.

According to example aspects, the antenna node 400 can be configured to transmit a signal through the antenna 480, which can radiate radio waves that carry the signal. For example, as shown in the aspect of FIG. 7, the antenna node 400 can be attached to the water meter radio unit 710, and the antenna 480 can transmit a signal carrying water consumption data, which can be wirelessly received by a meter reading device (not shown). Example aspects of the antenna node 400 can be mounted on the water meter radio unit 710 by the mounting bracket 570. As shown, a portion of the arm 572 of the mounting bracket 570 can abut a lip 712 of the water meter radio unit 710. The lip 712 can define mounting holes 714 configured to align with the mounting holes 574 (shown in FIG. 5) of the mounting bracket 570. One or more mounting fasteners (not shown) can be provided and can extend through a pair of the corresponding mounting holes 574,714 to couple the mounting bracket 570 to the lip 712. In one example aspect, the mounting fastener can be a nut and bolt assembly, and in other aspects, the mounting fastener can be any other suitable fastener known in the art.

In example aspects, as shown in FIG. 7, the diameter D1 of the outer surface 120 of the sidewall 110 can be less than a diameter D3 of the outer surface 436 of the collar 430, such that a step 720 can be defined between the antenna cap 100 and the collar 430 (i.e., the antenna cap 100 may not be flush with the collar 430.) In other aspects, the diameter D1 of the outer surface 120 of the sidewall 110 can be greater than the diameter D3 of the outer surface 436 of the collar 430.

Figure 8:
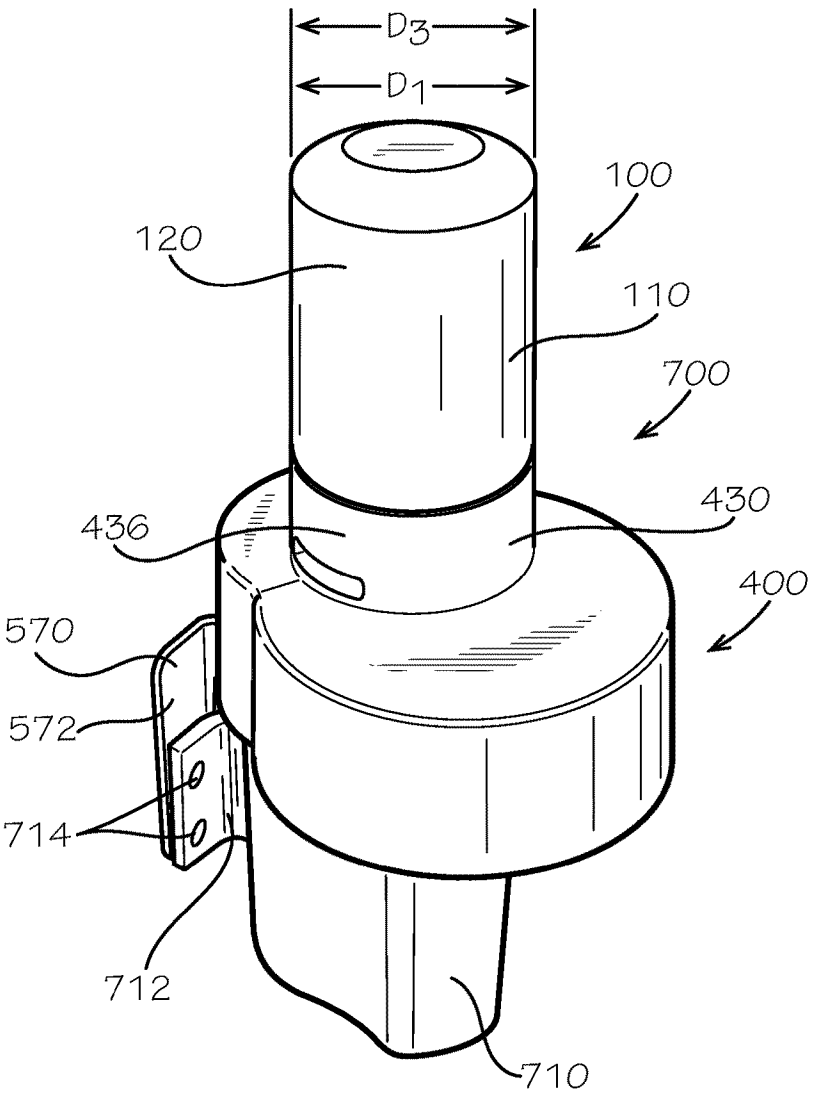
FIG. 8 is a top perspective view of the antenna assembly comprising the antenna node of FIG. 4 and the antenna cap of FIG. 3, in accordance with another aspect of the present disclosure.

In still other aspects, such as the aspect depicted in FIG. 8, the diameter D1 of the outer surface 120 of the sidewall 110 can substantially match the diameter D3 of the outer surface 436 of the collar 430, such that the antenna cap 100 can be substantially flush with the collar 430. The flush appearance can provide an appealing aesthetic and can further provide the impression that the antenna cap 100 is monolithically formed with the antenna node 400. Such an impression can sway a user away from removing the antenna cap 100 from the antenna node 400 unnecessarily and exposing the antenna 480 to damaging external factors. Furthermore, in some aspects, the color of the antenna cap 100 can be substantially similar to the color of the antenna node 400 to support the impression that the antenna cap 100 and antenna node 400 are monolithically formed, to further sway a user away from removing the antenna cap 100. In example aspects, the flush appearance of the antenna cap 100 with the collar 430 can also indicate that the antenna cap 100 is properly attached to the antenna node 400.

A method for attaching the antenna cap 100 to the antenna node 400 can comprise providing the antenna node 400, wherein the antenna node 400 comprises the antenna 480, inserting the antenna 480 into the cap cavity 240 of the antenna cap 100 through the opening 218 of the antenna cap 100, and attaching the antenna cap 100 to the antenna node 400. In some example aspects, attaching the antenna cap 100 to the antenna node 400 can comprise removably attaching the antenna cap 100, such that the antenna cap 100 can be removed from the antenna node 400, as desired. Furthermore, in some aspects, attaching the antenna cap 100 to the antenna node 400 can comprise coupling the fastener 150 of the antenna cap 100 with the mating fastener 450 of the antenna node 400. In one example aspect, the fastener 150 of the antenna cap 100 can be the threading 152, and the mating fastener 450 of the antenna node 400 can be the complementary threading 452. The method can comprise engaging the threading 152 with the complementary threading 452 and twisting the antenna cap 100 relative to the antenna node 400 to tighten the antenna cap 100 on the antenna node 400.

A method for installing the antenna assembly 700 to the water meter radio unit 710, or another piece of equipment, is also provided. In one aspect, the method can comprise abutting a mounting bracket 570 of the antenna assembly 700 against the water meter radio unit 710 and coupling the mounting bracket 570 to the water meter radio unit 710 by a mounting fastener (not shown). In some aspects, the method can comprise inserting the mounting fastener through a first mounting hole 574 in the mounting bracket 570 and a second mounting hole 714 in the water meter radio unit 710. The method further can comprise tightening the mounting fastener to secure the antenna assembly 700 relative to the water meter radio unit 710. Example aspects of the method can further comprise removing the antenna cap 100 from the antenna node 400 after tightening the mounting fastener to secure the antenna assembly 700 relative to the water meter radio unit 710, or other piece of equipment. For example, removing the antenna cap 100 from the antenna node 400 can comprise de-coupling the fastener 150 of the antenna cap 100 from the mating fastener 450 of the antenna node 400. In one example aspect, the fastener 150 of the antenna cap 100 can be the threading 152, and the mating fastener 450 of the antenna node 400 can be the complementary threading 452. As such, removing the antenna cap 100 from the antenna node 400 can comprise twisting the antenna cap 100 relative to the antenna node 400 to loosen the antenna cap 100 until the threading 152 is fully disengaged from the complementary threading 452.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. An antenna cap for an antenna node comprising:

a housing, the housing defining an elongate continuous sidewall, the continuous sidewall defining a first end and a second end, an end wall extending from the first end, the end wall and continuous sidewall defining an interior cavity for receiving an antenna, an opening defined at the second end and configured for access to the interior cavity, wherein the end wall defines a flat center region and a curved peripheral region surrounding the flat center region, the curved peripheral region flush with the first end of the continuous sidewall to define a smooth transition between the end wall and the continuous sidewall, the flat center region perpendicular to the continuous sidewall; and a fastener proximate the second end and configured for attaching the housing to the antenna node, the fastener formed with the continuous sidewall, wherein a length of the continuous sidewall between the first end and the fastener is greater than a length of the fastener, and wherein the continuous sidewall defines a consistent outer sidewall diameter from the first end to the fastener;

wherein:

the antenna cap defines an outer cap surface;

a maximum diameter of the outer cap surface at the fastener is less than the consistent outer sidewall diameter;

the housing further defines an outer housing surface and inner housing surface;

the fastener is a threaded fastener comprising threading;

the threading extends outward from the outer cap surface of the continuous sidewall;

the continuous sidewall defines a sidewall diameter; and the threading defines a threading diameter that is greater than the sidewall diameter.

2. The antenna cap of claim 1, wherein a thread form of the threading is rectangular.

3. The antenna cap of claim 1, wherein the continuous sidewall defines a cross-sectional shape of one of a circle, oval, rectangle, triangle, pentagon, and hexagon.

4. The antenna cap of claim 3, wherein the cross-sectional shape of the continuous sidewall is a circle.

5. The antenna cap of claim 1, and wherein an end wall diameter of the end wall tapers between the continuous sidewall and the flat center region.

6. The antenna cap of claim 1, wherein the flat center region is vertically offset from the continuous sidewall in a vertical orientation of the antenna cap.

7. The antenna cap of claim 1, wherein a length of the antenna cap is greater than the consistent outer sidewall diameter of the continuous sidewall.

8. A method for installing an antenna assembly on equipment comprising:

providing the antenna assembly comprising an antenna cap, an antenna node, and an antenna, the antenna cap defining an interior cap cavity, the antenna node comprising a node housing and a collar monolithically formed with and extending from the node housing;

receiving a first portion of the antenna through an opening of the collar and into a housing cavity of the node housing;

receiving a second portion of the antenna into the interior cap cavity;

attaching the antenna cap to the collar of the antenna node with a cap fastener of the antenna cap;

abutting a mounting bracket of the antenna assembly with the equipment; and fastening the mounting bracket of the antenna assembly to the equipment with a mounting fastener;

wherein:

the antenna cap comprises a continuous sidewall and defines an outer cap surface;

the cap fastener is a threaded cap fastener comprising threading;

the threading extends outward from the outer cap surface;

the continuous sidewall defines a sidewall diameter; and the threading defines a threading diameter that is greater than the sidewall diameter.

9. The method of claim 8, wherein:

the node housing comprises a sidewall enclosure and a top cover;

the antenna comprises a sheath formed integrally with and fixedly secured to the top cover;

the antenna is formed integrally with the antenna node; and a lower section of the sheath extends into the housing cavity of the node housing.

10. The method of claim 8, further comprising removing the antenna cap from the antenna node after fastening the mounting bracket of the antenna assembly to the equipment with the mounting fastener.

11. The method of claim 8, wherein the mounting bracket defines a substantially flat arm extending from a sidewall enclosure of the node housing, at least one mounting hole formed through the substantially flat arm.

12. The method of claim 11, wherein abutting the mounting bracket of the antenna assembly with the equipment comprises abutting the mounting bracket of the antenna assembly with a water meter radio unit, the water meter radio unit wired to a water meter.

13. The method of claim 8, wherein a slot extends through the collar from an inner collar surface of the collar to an outer collar surface of the collar to permit fluid within the collar bore to drain out of the antenna node through the slot.

14. The method of claim 13, wherein:

the a continuous sidewall defining an inner sidewall surface and an outer sidewall surface; and the outer sidewall surface is flush with the outer collar surface of the antenna node.

15. The method of claim 14, wherein:

the collar defines a threaded collar bore; and attaching the antenna cap to the collar of the antenna node comprises rotating the threaded cap fastener within the threaded collar bore to tighten the antenna cap on the collar.

* * * * *